US006910548B2

(12) United States Patent
Powell

(10) Patent No.: US 6,910,548 B2
(45) Date of Patent: Jun. 28, 2005

(54) MODULAR SPEAKER CONSTRUCTION

(75) Inventor: Mark H. Powell, Marina del Rey, CA (US)

(73) Assignee: Gibson Guitar Corp., Nashville, TN (US)

( * ) Notice: Subject to any disclaimer, the term of this patent is extended or adjusted under 35 U.S.C. 154(b) by 114 days.

(21) Appl. No.: 10/403,529

(22) Filed: Mar. 31, 2003

(65) Prior Publication Data

US 2003/0213642 A1 Nov. 20, 2003

Related U.S. Application Data

(60) Provisional application No. 60/416,121, filed on Oct. 4, 2002, and provisional application No. 60/370,267, filed on Apr. 5, 2002.

(51) Int. Cl.[7] ..... A47B 81/06
(52) U.S. Cl. ..... 181/199
(58) Field of Search ..... 181/198, 199, 181/200, 201–205

(56) References Cited

U.S. PATENT DOCUMENTS

| | | | | |
|---|---|---|---|---|
| 1,828,088 A | | 10/1931 | Robinson | |
| 4,139,734 A | | 2/1979 | Fincham | 179/1 |
| 4,284,168 A | | 8/1981 | Gaus | 181/199 |
| 4,811,403 A | | 3/1989 | Henricksen et al. | 381/87 |
| 5,218,176 A | * | 6/1993 | Meyer, Jr. | 181/199 |
| 5,627,350 A | | 5/1997 | Kang | 181/199 |
| 5,979,591 A | | 11/1999 | Harrson | 181/199 |
| 5,996,728 A | | 12/1999 | Stark | 181/144 |
| 6,035,962 A | | 3/2000 | Lin | 181/199 |
| 6,425,456 B1 | | 7/2002 | George | 181/199 |
| 6,513,624 B2 | | 2/2003 | Coffin | 181/199 |
| 6,571,909 B1 | | 6/2003 | Olinger | 181/199 |

* cited by examiner

*Primary Examiner*—Kimberly Lockett
(74) *Attorney, Agent, or Firm*—Waddey & Patterson, P.C.; Lucian Wayne Beavers

(57) ABSTRACT

A housing for a loudspeaker is presented, and which includes a plurality of corner units, each of the corner units having a first end and a second end and also has a first inner spline extending therefrom and a second inner spline extending therefrom; and a first outer spline extending therefrom and running generally parallel to the first inner spline and a second outer spline extending therefrom and running generally parallel to the second inner spline, wherein the first inner spline and the first outer spline cooperate to form a first slot sized to receive a top panel or a bottom panel and the second inner spline and the second outer spline cooperate to form a second slot sized to receive a side panel.

23 Claims, 6 Drawing Sheets

MODULAR SPEAKER CONSTRUCTION

RELATED APPLICATION

This application claims benefit under 35 U.S.C. §119(e) of co-pending U.S. Provisional Patent Application Ser. No. 60/416,121 filed Oct. 4, 2002, entitled "Framework for Speaker Construction," and U.S. Provisional Patent Application Ser. No. 60/370,267 filed Apr. 5, 2002, entitled "Modular Construction for Speakers," the details and disclosure of each of which are hereby incorporated by reference.

Be it known that I, Mark H. Powell, a citizen of Breat Britain, residing at 13969 Marquesas Way, #207B, Marina Del Ray, Calif., 90292, have invented a new and useful invention entitled, "Modular Speaker Construction."

BACKGROUND OF THE INVENTION

1. Field of the Invention

The present invention relates generally to a loudspeaker cabinet, more particularly, the invention relates to a speaker cabinet useful for professional audio equipment that allows for disassembly, servicing and reconfiguration of the speaker as well as ease of mounting.

2. Description of the Prior Art

Traditional speaker cabinets are generally constructed from six panels (two side panels, a top and a bottom panel, and a front grill and rear panel), such as wooden panels, connected together to form a structural box within which the speaker components are located. In these traditional designs, disassembly for repair, replacement or reconfiguration of the speaker components is cumbersome, if possible at all. Indeed, damage or destruction of the panels is often the case when speaker disassembly is attempted.

Moreover, in traditional speaker cabinet designs, mounting of the speaker cabinet, such as in an overhead mounting arrangement often found in professional environments, such as arenas, nightclubs, etc., can be difficult and unwieldy and require mounting hardware to be provided on or in the wooden sides.

There is a need in the art for an improved speaker housing construction which would provide for ready interchangeability of parts, ease of access for assembly and replacement or reconfiguration of internal components, and which facilitates mounting in a variety of orientations. Although there are many examples of prior art loudspeaker enclosures, none provide the sought after advantages. For instance, Gaus, in U.S. Pat. No. 4,284,168, discloses a loudspeaker enclosure comprising layers of metal and plastic to provide density, high modulus of elasticity, and a high damping factor. However, the Gaus configuration does not provide for ease of disassembly for reconfiguration or repair and replacement of components, nor does Gaus provide a ready and convenient mounting method. Meyer, Jr. describes another type of speaker enclosure in U.S. Pat. No. 5,218,176 which, according to the inventor, provides unique acoustical and structural properties and which consists of a porous inner core of rigid urethane foam bonded to fiberglass rovings by means of polyester resin and resin tie blocks. Clearly therefore, the Meyer, Jr. construction does not facilitate ease of disassembly or reconfiguration.

Lin, in U.S. Pat. No. 6,035,962, Stark in U.S. Pat. No. 5,996,728, and Kang in U.S. Pat. No. 5,627,350 all claim speaker housings assembled in different manners. None of the disclosed housings, however, provide the modular assembly, ease of disassembly, reconfiguration or replacement of components, and mounting capabilities desired in the art.

Thus, there is a continuing need in the art for improved loudspeaker housings which would provide ease of interchangeability of parts for repair or reconfiguration, as well as stable and reliable mounting systems.

SUMMARY OF THE INVENTION

The present invention provides a speaker housing which comprises a unitary housing skeleton. The unitary housing skeleton includes a plurality of corner elements as well as plurality of cross supports. At least one of the pluralities of cross supports extends between two adjacent corner elements to form a speaker housing skeleton.

In the preferred embodiment, the inventive speaker housing skeleton comprises four corner elements or units with cross supports extending between each of the corner elements to thereby define a speaker housing skeleton having top, bottom, front, back, left and right sides.

Top, bottom, left and right side housing panels can then be attached to the corner elements and front and rear screens or panels (sometimes also referred to as grills or baffles) also attached to the corner elements, in order to form the speaker housing. Mounting tabs, for further securing the front and rear panels to the cross supports, are provided to provide for the assembly and disassembly of the speaker and removal and/or interchange of speaker components.

The corner elements contain integrated slots to facilitate insertion of housing panels, fittings for mounting of front and rear baffles or panels, and external mounting channels for mounting of the speaker.

Accordingly, it is an object of the present invention to provide an improved construction for a speaker housing.

Another object of the present invention is the provision of a speaker assembly having a unitary housing framework or skeleton which provides sufficient structural strength to support the external loads placed upon the housing assembly so that side panels are not required to provide structural strength.

Another object of the present invention is the provision of a speaker housing providing access to the internal components of the speaker for ease of manufacture, maintenance and reconfiguration.

Still another object of the invention is the provision of a family of speakers having interchangeable components.

These objects and others which will be apparent to the skilled artisan can be achieved by the provision of a housing for a loudspeaker which has two side panels, a top panel, a bottom panel, a front panel and a back panel, and which includes a plurality of corner units typically four corner units: two top units and two bottom units), each of the corner units having a first end and a second end and comprising a first inner spline extending therefrom and a second inner spline extending therefrom, the first and second inner splines defining planes offset from each other by an angle of from about 75° and about 105°; and a first outer spline extending therefrom and running generally parallel to the first inner spline and a second outer spline extending therefrom and running generally parallel to the second inner spline, wherein the first inner spline and the first outer spline cooperate to form a first slot sized to receive a top panel or a bottom panel and the second inner spline and the second outer spline cooperate to form a second slot sized to receive a side panel.

The inventive corner units further have a fitting at each end thereof, each fitting sized to receive a mounting element for one of the front and back panels. The corner units further include at least one (and preferably two) mounting channel (s) extending along the length thereof; when two mounting channels are present, they each defining a plane extending generally orthogonal to each other.

The inventive speaker housing further comprises a cross support extending between the first inner spline of a first bottom corner unit and the first inner spline of a first top corner unit; a cross support extending between the first inner spline of a second bottom corner unit and the first inner spline of a second top corner unit; a cross support extending from the second inner spline of a first top corner unit and the second inner spline of the second top corner unit; and a cross support extending from the second inner spline of a first bottom corner unit and the second inner spline of the second bottom corner unit. Thus, the corner units and cross supports combine to form a housing skeleton.

Two side panels, a top panel and a bottom panel are each engaged in the slots formed by the inner and outer splines of the corner units. In addition, a front panel (which can be a baffle, grill or screen) is attached to the housing skeleton by a mounting element engaged by the fittings at the front end of the corner units. And, a back panel is attached to the housing skeleton by a mounting element engaged by the fittings at the back end of the corner units.

It is to be understood that both the foregoing general description and the following detailed description present embodiments of the invention and are intended to provide an overview or framework of understanding and nature and character of the invention as it is claimed. The accompanying drawings are included to provide a further understanding of the invention and are incorporated in and constitute a part of the specification. The drawings illustrate various embodiments of the invention and together with the description serve to explain the principles and operations of the invention.

DESCRIPTION OF THE PREFERRED EMBODIMENTS

Figure 1:
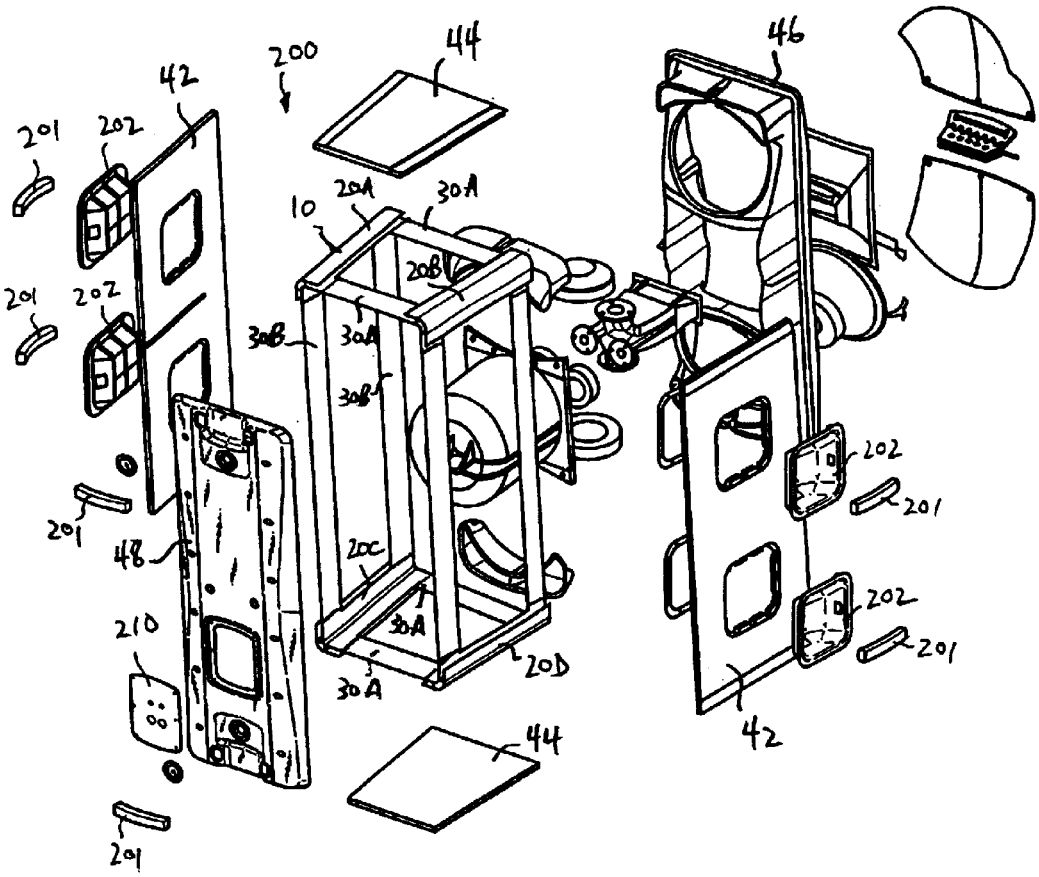
FIG. 1 is an exploded view of a speaker housing in accordance with the present invention.

Embodiments of the present invention will now be described in greater detail. Like or similar reference numerals will be used whenever possible, although, for greater clarity, not all reference numerals will be used in all drawings. The housing skeleton of the present invention will be described in terms of inclusion of a professional loudspeaker apparatus; such is for convenience only. It will be understood that the inventive housing can be applied to any speaker system or indeed any container having the same general requirements. Likewise, the invention will be described with respect to a specific orientation and relationship of elements with respect to each other, but it will be recognized by the skilled artisan that other orientations and relationships will be equally applicable.

Figure 5:
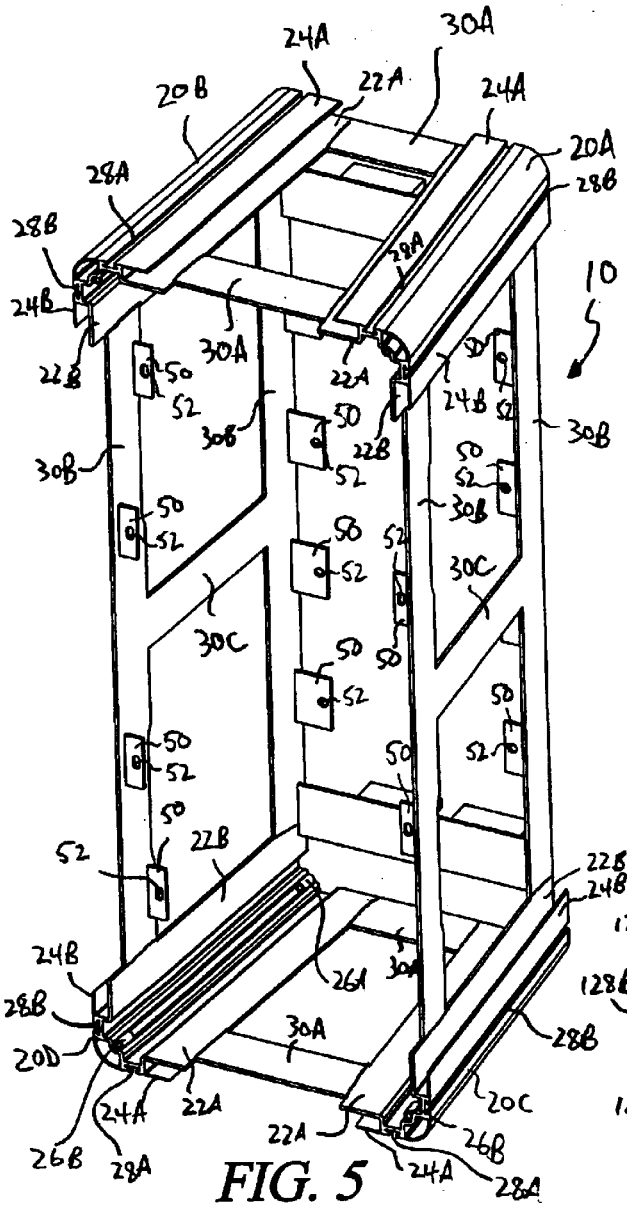
FIG. 5 is a rear perspective view of a speaker housing skeleton in accordance with the present invention.
Figure 7:
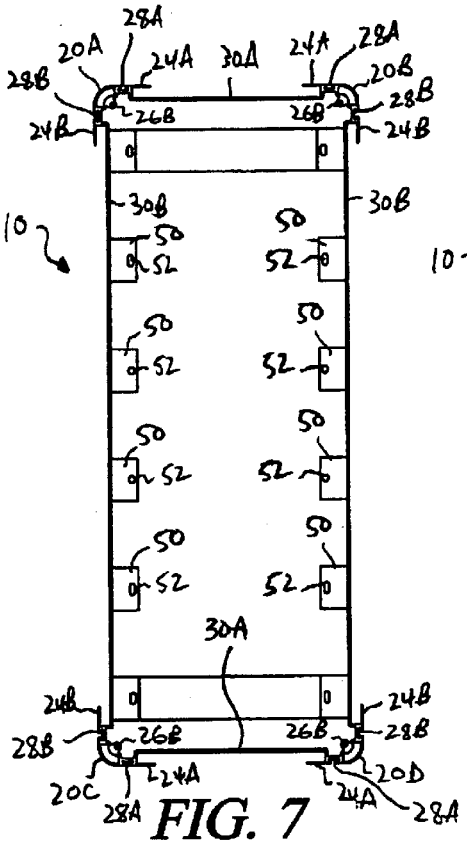
FIG. 7 is a front plan view of the speaker housing skeleton of FIG. 5.

Referring now to FIGS. 5 and 7, a speaker housing skeleton is illustrated by the reference numeral 10. Housing skeleton 10 comprises a plurality of corner units (also sometimes referred to as corner elements) 20. Most preferably, speaker housing 10 comprises four corner units 20, one for each of the two top corners of speaker housing skeleton 10 and one for each of the two bottom corners of speaker housing skeleton 10. As can be seen in FIG. 7, corner units 20A and 20B comprise the upper corners of housing skeleton 10 and corner units 20C and 20D comprise the lower corners of housing skeleton 10.

Figure 2:
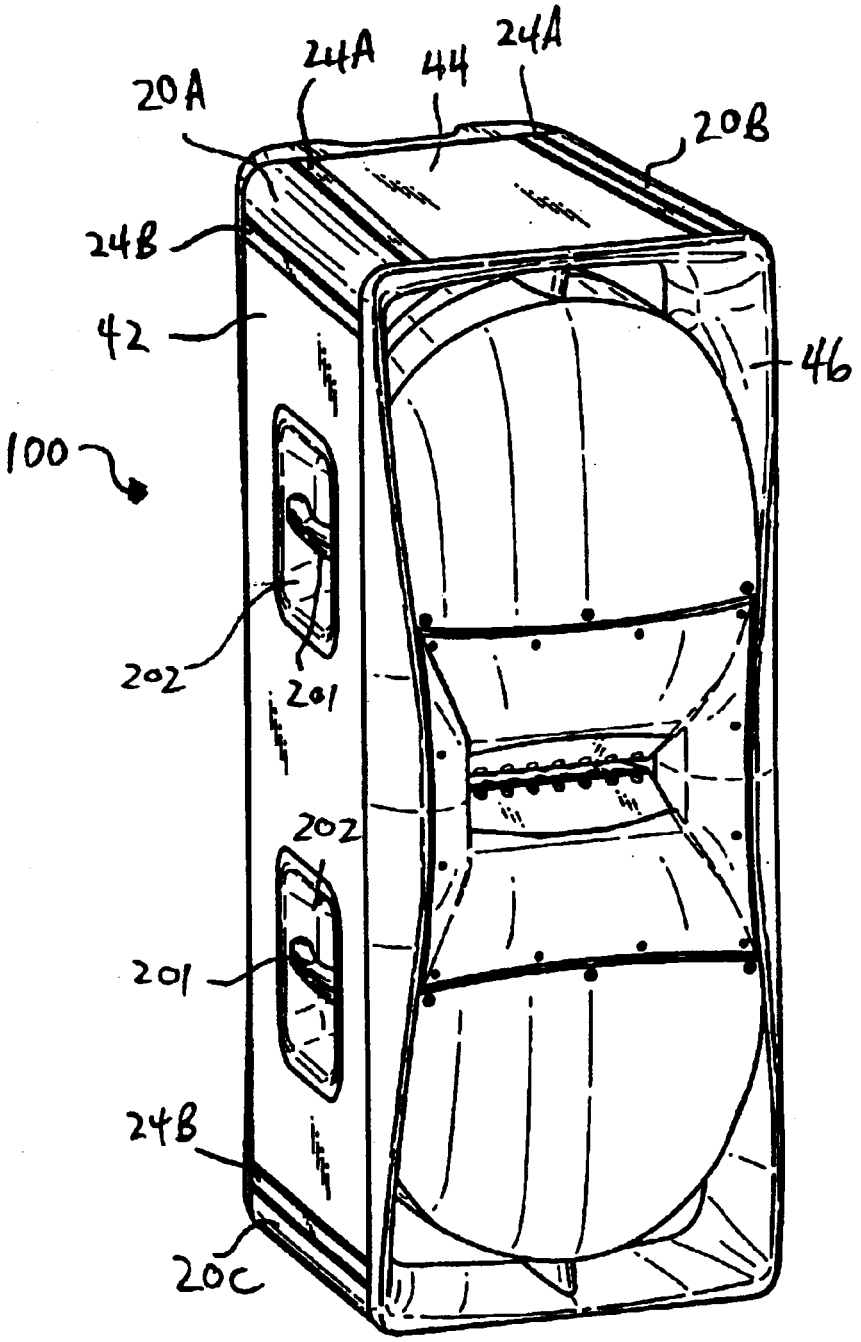
FIG. 2 is a front perspective view of a speaker housing in accordance with the present invention.
Figure 3:
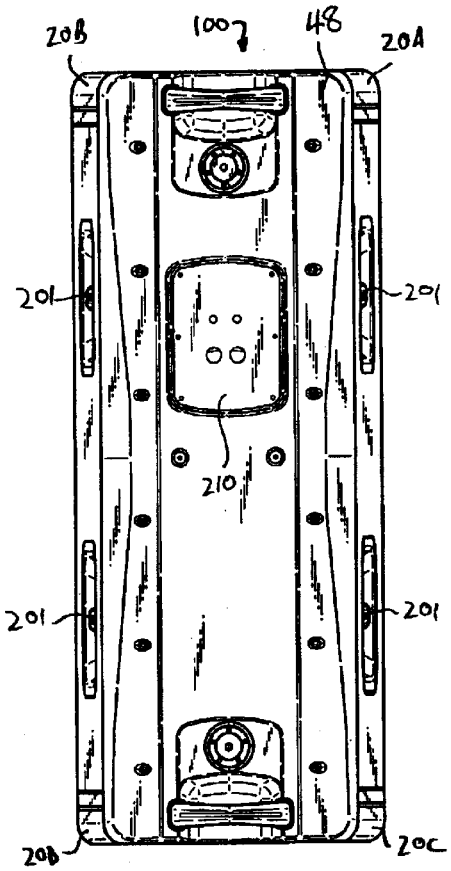
FIG. 3 is a rear elevation view of the speaker housing of FIG. 2.
Figure 4:
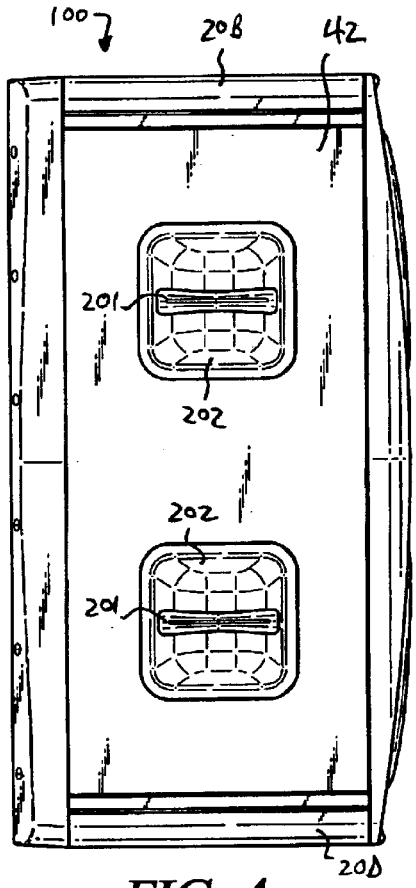
FIG. 4 is a side elevation view of the speaker housing of FIG. 2.
Figure 11:
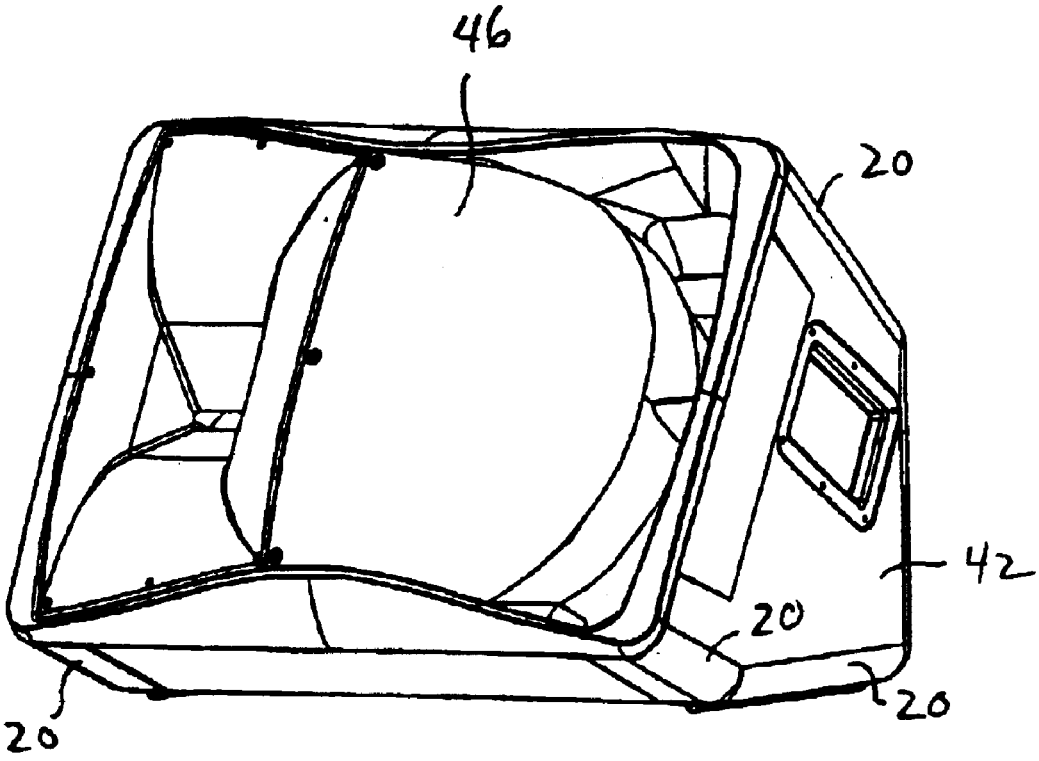
FIG. 11 is a front perspective view of an alternate embodiment of a speaker housing in accordance with the present invention.

This description is written generally in terms of the speaker configuration shown in FIGS. 2–4, that is, a generally rectangular speaker; it will be recognized, however, that other speaker configurations, such as that illustrated in FIG. 11, can also be provided using the speaker housing skeleton 10 concepts taught herein.

Corner units 20 can be formed of aluminum or other like metal, plastic resins or the like and can be formed by extruding, casting, machining or other like processes familiar to the artisan. Although, as illustrated in FIG. 10, corner units 20 assume a rounded orientation at 21A, in fact portion 21A can be a right angle or other shape as desired.

Figure 10:
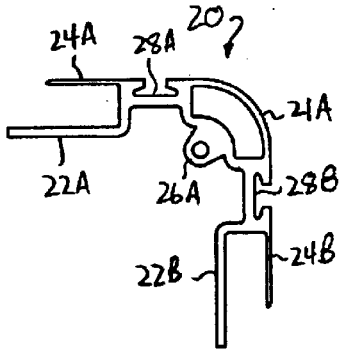
FIG. 10 is a plan view of one of the corner units in accordance with the present invention.

As best illustrated in FIG. 10, corner units 20 each comprise first and second inner arms or splines 22A and 22B extending therefrom in different directions. First and second inner splines 22A and 22B each define a plane which is offset with respect to each other by an angle which can range from about 75° to about 105°; most preferably, inner splines 22A and 22B extend from corner units 20 at substantially right angles with respect to each other.

Corner units 20 further comprise first and second outer arms or splines 24A and 24B, which are oriented with respect to inner splines 22A and 22B so as run generally parallel thereto and to form a pair of slots running the length of corner units 20. As illustrated in FIGS. 5, 7 and 10, a first slot is formed between splines 22A and 24A and a second slot is formed between splines 22B and 24B. Because of the orientation of inner splines 22A and 22B with respect to each other, the slots formed between inner splines 22A and 22B and outer splines 24A and 24B extend in planes offset from each other by an angle of between about 75° and 105°; most preferably, the two slots are orthogonal to each other. Based on the orientation of corner units 20 as shown in FIG. 5, the slot formed between arms 22A and 24A can be referred to as a horizontal slot and the slot formed between arms 22B and 24B can be referred to as a vertical slot.

Figure 6:
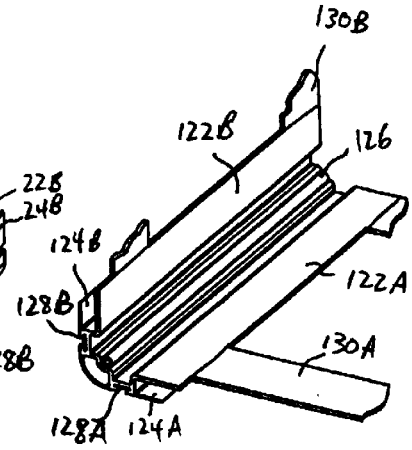
FIG. 6 is a perspective view of an alternate embodiment of one of the corner units in accordance with the present invention.

Corner units 20 further comprises a fitting 26 which can be used for the mounting of a screen, baffle or other front or rear panel of a speaker housing thereto via a screw, rivet, bolt or other like attachment element. In one embodiment, illustrated in FIG. 5, corner element 20 has a front fitting 26A at a front end thereof and a rear fitting 26B at the other end thereof for the attachment of one or more of panels, baffles, grills, screens, etc. to the front and back of speaker housing skeleton 10, respectively. Alternatively, as illustrated in FIG. 6, corner units 120 can comprise a fitting 126 which extends the length of corner element 120 and be used for the attachment of front and back panels, etc. in that manner.

Figure 8:
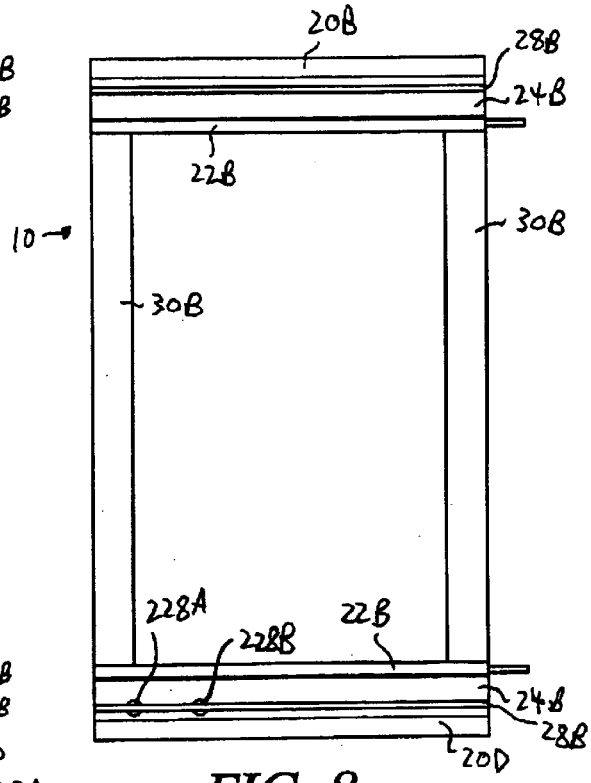
FIG. 8 is a side plan view of the speaker housing skeleton of FIG. 7.

In a preferred embodiment, corner units 20 further have formed therein at least one channel 28, and more preferably, two channels, 28A and 28B, as illustrated in FIGS. 5 and 7. Channels 28A and 28B are formed to have a cross sectional profile which adopts standard cargo-style locking track dimensions which are an accepted aerospace industry standard and which are commonly used in the speaker rigging hardware industry. Channels 28A and 28B can be formed into corner units 20 during the extrusion or other formation process or they can be milled into units 20 after formation. A plurality of circular hardware attachment points can then be machined into the exterior of channels 28A and 28B in any desired location which can be tailored to each specific speaker housings rigging requirements or which can be equally spaced along the entire length of channels 28A and 28B. Exemplary of such circular hardware attachment points are illustrated as 228A and 228B in FIG. 8.

As best illustrated in FIGS. 1 and 5, speaker housing skeleton 10 further comprises a plurality of cross supports 30, which can be denoted as horizontal cross supports 30A and vertical cross supports 30B. Horizontal cross supports 30A extend between inner spline 22A in one of corner units 20 and inner spline 22A of a horizontally adjacent corner unit 20, and vertical cross supports 30B extend between inner spline 22B of one corner unit 20 and inner spline 22B of a vertically adjacent corner unit 20. Preferably, and as illustrated in FIG. 5, cross supports 30A and 30B extend between corner units 20 at both the front end and back end of corner units 20. Thus, if four cross supports (two each of cross supports 30A and 30B) are employed at both the front and back ends of corner units 20, all four corner units 20 are connected and form a single unitary structural framework or skeleton 10. Cross supports 30A, 30B are attached to inner splines 22A, 22B respectively either by welding, by mounting elements such as screws, bolts, rivets, etc. or by any other manner which will reliably secure cross supports 30A, 30B to inner splines 22A, 22B. Additional supports, such as mid-length supports 30C can also be employed, if desired.

Figure 9:
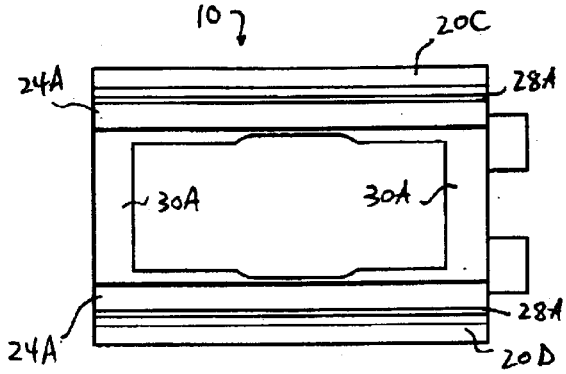
FIG. 9 is a bottom plan view of the speaker housing skeleton of FIG. 7.

In a preferred embodiment, as illustrated in FIG. 9, the horizontal cross supports 30A can be provided as an integral unit at both the top and bottom of speaker housing skeleton 10; likewise, the vertical cross supports 30B can also be provided as an integral unit at both the left and right sides of speaker housing skeleton 10. In this way, the structural strength of speaker housing skeleton 10 is even further improved.

In forming a speaker housing 100 from speaker housing skeleton 10, side panels 42 can be engaged in the vertical slots of corner units 20, and top and bottom panels 44 can be engaged in the horizontal slots of corner units 20. These side, top and bottom panels 42, 44 can be formed of wood, nomex, composites of honeycomb or other materials suitable for acoustic requirements. Side, top and bottom panels 42, 44 may have edges which are thinned for receipt in vertical and horizontal slots, however, that is not necessarily the case. Front and rear panels 46 and 48 can then be mounted to fittings 26 and thus held in place to form the front and rear of speaker housing 100. Indeed, when properly dimensioned, front and rear panels 46 and 48, when secured into place, can also function to hold side panels and top and bottom panels 42, 44 in place in the horizontal and vertical slots formed in corner units 20. Alternatively, or in addition, side and top and bottom panels 42, 44 can be glued in place in the horizontal and vertical slots formed in corner units 20.

In the most preferred embodiment, speaker housing 100 is assembled by placing each of the side panels and top panels 42, 44 within the horizontal and vertical slots formed in corner units 20, and then securing the front and rear panels 46, 48 to corner units 20 with screws, bolts or the like extending into fittings 26.

Cross supports 30 are preferably formed from strips of aluminum or other metal having a thickness substantially equal to the thickness of inner splines 22. Most preferably, cross supports 30 are formed of the same material as is used to form corner units 20. Cross supports 30 are butted up against the butt ends of inner splines arms 22 and are welded or otherwise joined by conventional techniques. The lines or abutment or weld are finished as smoothly as possible to permit easy access of panels 42, 44 into the slots formed in corner units 20.

Cross supports 30 are designed to be of the thickness compliant with the requirements of load bearing and therefore are generally equal to the thickness to the inner splines 22 of corner units 20. For example, cross supports 30 can be constructed from 3/16-inch thick 6061 aluminum alloy.

A plurality of mounting tabs denoted 50 can be attached, such as by welding, to cross supports 30. Each of mounting tabs 50 has a mounting element, such as a bolt hull 52 or similar mounting element defined therein which can be used for further attachment of front and rear panels 46, 48, or of speaker components, such as those illustrated (but not all of which are numbered) in FIG. 1.

A speaker housing 100 utilizing the speaker housing skeleton 10 of the present invention is generally manufactured and assembled in the following manner. Four corner units 20 are prepared as described hereinabove. Cross supports 30 are welded between corner units 20 such that each cross support 30 spans between two corner units 20 and is welded thereto. The cross supports 30 and corner units 20 form a unitary structural framework as shown in FIG. 5. Following formation of housing skeleton 10, top, bottom, left side and right side housing panels 42, 44 are slid into the slots formed in corner units 20. Panels 42, 44 and/or the slots may first be coated with glue or other adhesive to promote adhesion. Front and back panels 46, 48 are then detachably attached to speaker housing skeleton 20 by screw, bolts, or other attachment devices which engage fittings 26.

Referring now to FIG. 1, a speaker system 200 made with speaker housing 100 is illustrated. The speaker system 200 includes handles 201, some of which is received in a handle pocket 202 which is mounted in a side panel 42.

In terms of internal components, as would be familiar to the skilled artisan, they may include components such as internal port flares, as well as horn perforations, which may also be described as perforated acoustic filters. A horn bell can be received through the central most opening of the front panel 46. A horn bell can be attached to horn throat. A typical speaker configuration is shown in FIG. 1. As illustrated in FIGS. 1 and 3, a connector plate 210 can be mounted in the rear panel.

Of course, the skilled artisan will recognize that a variety of configurations and components are possible for speaker system 200.

Speaker housing 100 provides several major benefits to the overall design philosophy of a speaker system. First, it provides a sufficiently strong structure to meet or exceed the load bearing requirements of the speaker assembly without relying on any of the side, top or bottom panels or other components for additional structural strength. Secondly, it provides a manufacturing jig for complete assembly of the rest of the speaker's components, including providing a gluing jig for the four side, top and bottom panels. Rubber gaskets may also be provided to provide a seal between the front and rear baffles and skeleton 20. The completed assembly is serviceable and upgradeable due to the nature of this construction methodology which allows the front and rear panels to be removed to access and replace or service internal components.

All cited patents and publications referred to in this application are incorporated by reference. The invention thus being described, it will be apparent that it may be varied in many ways. Such variations are not to be regarded as a departure from the spirit and scope of the present invention and also such modifications which would be apparent to one skilled in the art are intended to be included within the scope of the following claims.

What is claimed is:

1. A housing for a loudspeaker comprising two side panels, a top panel, a bottom panel, a front panel and a back panel, and which comprises a plurality of corner units, each of the corner units having a first end and a second end and comprising:

a. a first inner spline extending therefrom and a second inner spline extending therefrom, the first and second inner splines defining planes offset from each other by an angle of from about 75° and about 105°; and b. a first outer spline extending therefrom and running generally parallel to the first inner spline and a second outer spline extending therefrom and running generally parallel to the second inner spline, wherein the first inner spline and the first outer spline cooperate to form a first slot sized to receive a top panel or a bottom panel and the second inner spline and the second outer spline cooperate to form a second slot sized to receive a side panel.

2. The housing of claim 1 wherein the corner units further comprise a fitting at each end thereof, each fitting sized to receive a mounting element for one of the front and back panels.

3. The housing of claim 2 wherein the corner units further comprise at least one mounting channel extending along the length thereof.

4. The housing of claim 3 wherein the corner units each comprise two mounting channels extending the length thereof, the mounting channels each defining a plane extending generally orthogonal to each other.

5. The housing of claim 1 which comprises at least four corner units, two top corner units and two bottom corner units.

6. The housing of claim 5 which further comprises a cross support extending between the first inner spline of a first bottom corner unit and the first inner spline of a first top corner unit.

7. The housing of claim 6 which further comprises a cross support extending between the first inner spline of a second bottom corner unit and the first inner spline of a second top corner unit.

8. The housing of claim 7 which further comprises a cross support extending from the second inner spline of a first top corner unit and the second inner spline of the second top corner unit.

9. The housing of claim 8 which further comprises a cross support extending from the second inner spline of a first bottom corner unit and the second inner spline of the second bottom corner unit.

10. The housing of claim 9 wherein the corner units and cross supports combine to form a housing skeleton.

11. The housing of claim 10 which further comprises two side panels, a top panel and a bottom panel, each engaged in the slots formed by the inner and outer splines of the corner units.

12. The housing of claim 2 which further comprises a front panel attached to the housing by a mounting element engaged by the fittings at the front end of the corner units.

13. The housing of claim 12 wherein the front panel comprises a baffle.

14. The housing of claim 2 which further comprises a back panel attached to the housing by a mounting element engaged by the fittings at the back end of the corner units.

15. A housing for a loudspeaker comprising two side panels, a top panel, a bottom panel, a front panel and a back panel, and at least four corner units arrayed as two top corner units and two bottom corner units, each of the corner units having a first end and a second end and comprising:

a. a first inner spline extending therefrom and a second inner spline extending therefrom, the first and second inner splines defining planes offset from each other by an angle of from about 75° and about 105°;

b. a cross support extending between the first inner spline of a first bottom corner unit and the first inner spline of a first top corner unit;

c. a cross support extending between the first inner spline of a second bottom corner unit and the first inner spline of a second top corner unit;

d. a cross support extending from the second inner spline of a first top corner unit and the second inner spline of the second top corner unit; and e. a cross support extending from the second inner spline of a first bottom corner unit and the second inner spline of the second bottom corner unit, wherein the corner units and cross supports combine to form a housing skeleton.

16. The housing of claim 15 wherein the corner units each further comprise a first outer spline extending therefrom and running generally parallel to the first inner spline and a second outer spline extending therefrom and running generally parallel to the second inner spline, wherein the first inner spline and the first outer spline cooperate to form a first slot sized to receive a top panel or a bottom panel and the second inner spline and the second outer spline cooperate to form a second slot sized to receive a side panel.

17. The housing of claim 16 wherein the corner units further comprise a fitting at each end thereof, each fitting sized to receive a mounting element for one of the front and back panels.

18. The housing of claim 17 which further comprises a front panel attached to the housing skeleton by a mounting element engaged by the fittings at the front end of the corner units.

19. The housing of claim 18 wherein the front panel comprises a baffle.

20. The housing of claim 17 which further comprises a back panel attached to the housing skeleton by a mounting element engaged by the fittings at the back end of the corner units.

21. The housing of claim 15 wherein the corner units further comprise at least one mounting channel extending along the length thereof.

22. The housing of claim 21 wherein the corner units each comprise two mounting channels extending the length thereof, the mounting channels each defining a plane extending generally orthogonal to each other.

23. The housing of claim 15 which further comprises two side panels, a top panel and a bottom panel, each engaged in the slots formed by the inner and outer splines of the corner units.

* * * * *